US009246251B2

(12) United States Patent
Regnier et al.

(10) Patent No.: US 9,246,251 B2
(45) Date of Patent: Jan. 26, 2016

(54) HIGH DENSITY CONNECTOR

(71) Applicant: Molex, LLC, Lisle, IL (US)

(72) Inventors: Kent E. Regnier, Lombard, IL (US); Patrick R. Casher, North Aurora, IL (US); Michael Rowlands, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/398,633

(22) PCT Filed: May 3, 2013

(86) PCT No.: PCT/US2013/039459

§ 371 (c)(1),
(2) Date: Nov. 3, 2014

(87) PCT Pub. No.: WO2013/166380

PCT Pub. Date: Nov. 7, 2013

(65) Prior Publication Data

US 2015/0140861 A1 May 21, 2015

Related U.S. Application Data

(60) Provisional application No. 61/642,005, filed on May 3, 2012.

(51) Int. Cl.

| | |
|---|---|
| ***H01R 13/514*** | (2006.01) |
| ***H01R 12/71*** | (2011.01) |
| ***H01R 9/24*** | (2006.01) |
| ***H01R 12/72*** | (2011.01) |
| ***H01R 12/70*** | (2011.01) |
| ***H01R 13/652*** | (2006.01) |

(52) U.S. Cl.

CPC ..... *H01R 12/71* (2013.01); *H01R 9/2408* (2013.01); *H01R 9/2458* (2013.01); *H01R 12/7082* (2013.01); *H01R 12/724* (2013.01); *H01R 13/652* (2013.01)

(58) Field of Classification Search

CPC .... H01R 12/71; H01R 9/2408; H01R 9/2458; H01R 12/724; H01R 12/7082; H01R 13/652

USPC ..... 439/108, 540.1, 607.1, 701

See application file for complete search history.

(56) References Cited

U.S. PATENT DOCUMENTS

| | | | | |
|---|---|---|---|---|
| 5,474,472 | A | 12/1995 | Niwa et al. | |
| 7,775,802 | B2 | 8/2010 | Defibaugh et al. | |
| 8,668,524 | B2 * | 3/2014 | Lan | H01R 12/724 439/607.35 |
| 8,734,187 | B2 * | 5/2014 | De Geest | H01R 13/6587 439/607.05 |
| 8,814,595 | B2 * | 8/2014 | Cohen | H01R 13/6461 439/607.07 |
| 2003/0220019 | A1 | 11/2003 | Billman et al. | |
| 2011/0212633 | A1 | 9/2011 | Regnier et al. | |
| 2011/0300757 | A1 | 12/2011 | Regnier et al. | |

OTHER PUBLICATIONS

International Search Report for PCT/US2013/039459.

* cited by examiner

*Primary Examiner* — Khiem Nguyen
(74) *Attorney, Agent, or Firm* — Stephen L. Sheldon

(57) ABSTRACT

A connector can be provided that allows for improved route-out including straight-back routing. Signal and ground terminal tails can be arranged in a single row to help facilitate such functionality. Consequentially, a connector with two vertically stacked card slots can be provided that allows for straight back routing of the signal traces in four layers while still providing a compact connector design.

12 Claims, 20 Drawing Sheets

HIGH DENSITY CONNECTOR

RELATED APPLICATIONS

This application is a national phase of PCT Application No. PCT/US2013/039459, filed May 3, 2013, which in turn claims priority to U.S. Provisional Application No. 61/642,005, filed May 3, 2012, which is incorporated herein by reference in its entirety.

FIELD OF THE INVENTION

The present invention relates to the field of connectors, more specifically to the field of connectors suitable for use in applications where the connector is supported by a circuit board.

DESCRIPTION OF RELATED ART

Connectors are widely used to provide an interface between a circuit board and another connector (such as a plug connector). Due to the continual improvement in computing power and the increased demand for high bandwidth communication channels on the end user side, there has been increased demand for connectors that can handle higher density of transmission channels while at the same time there has been an increased desire to provide connectors that take up less space on a supporting circuit board. Consequentially, connector designs have continued to attempt to increase performance while at the same time increasing density. One major complication with this effort is that more closely arranged communication channels create cross-talk on neighboring channels, thus it becomes more challenging to improve data rates while providing for an increase in density that can actually be mounted on a circuit board. Another major concern for system level developers is that the space required to mount a connector is often not representative of the space needed to route out the connector on a circuit board. In particular, ground vias (which are required to electrically connect to ground terminals) tend to be positioned in locations that interfere with ideal signal trace routing configurations. Accordingly, certain individuals would appreciate further improvements in connector design.

BRIEF SUMMARY

A connector is disclosed that allows for very compact routing on a minimal number of layers while providing for high performance. In an embodiment, the connector includes pair of signal wafers that are positioned side-by side, each wafer including a first terminal with a contact, a tail and a body extending between the tail and contact so that a pair of the first terminals can form a differential pair. The differential pair can be configured to provide a broad-side coupled configuration in the body of the terminals. The tails are configured to be positioned in a line and the line can be positioned between the body of the different pairs. At least one of the wafers that forms the pair of wafers includes a tail stub that is electrically isolated from the first terminal and includes a tail. A ground wafer is provided adjacent one of the pair of wafers and can include one or more terminals that are arranged such that the body is aligned with the body of the terminals that provide the differential pair. The ground terminal omits a tail and instead the ground terminal is coupled to the tail stub in one of the signal wafers. A conductive member can connect a junction in the ground terminal to a junction in the tail stub.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
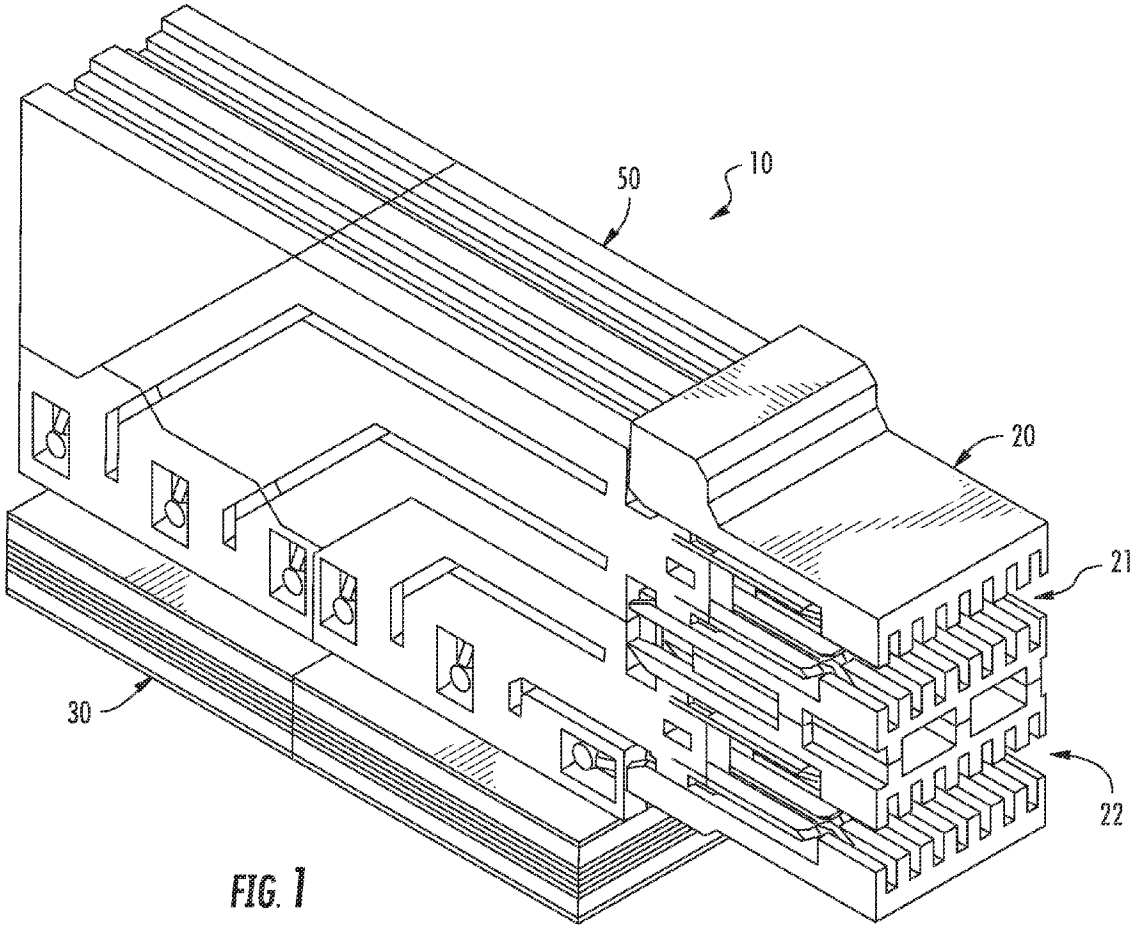
FIG. 1 illustrates a perspective view of an embodiment of a connector.
Figure 2:
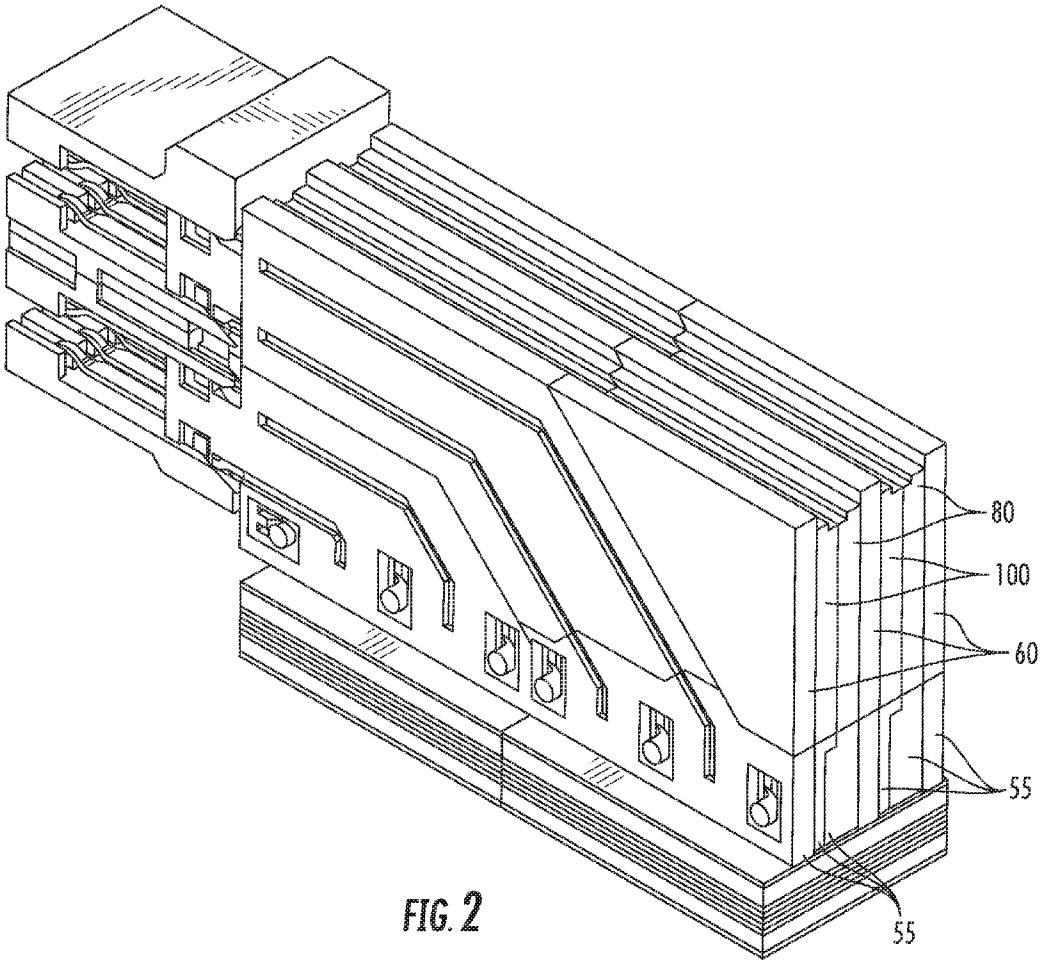
FIG. 2 illustrates another perspective view of the connector depicted in FIG. 1.
Figure 3:
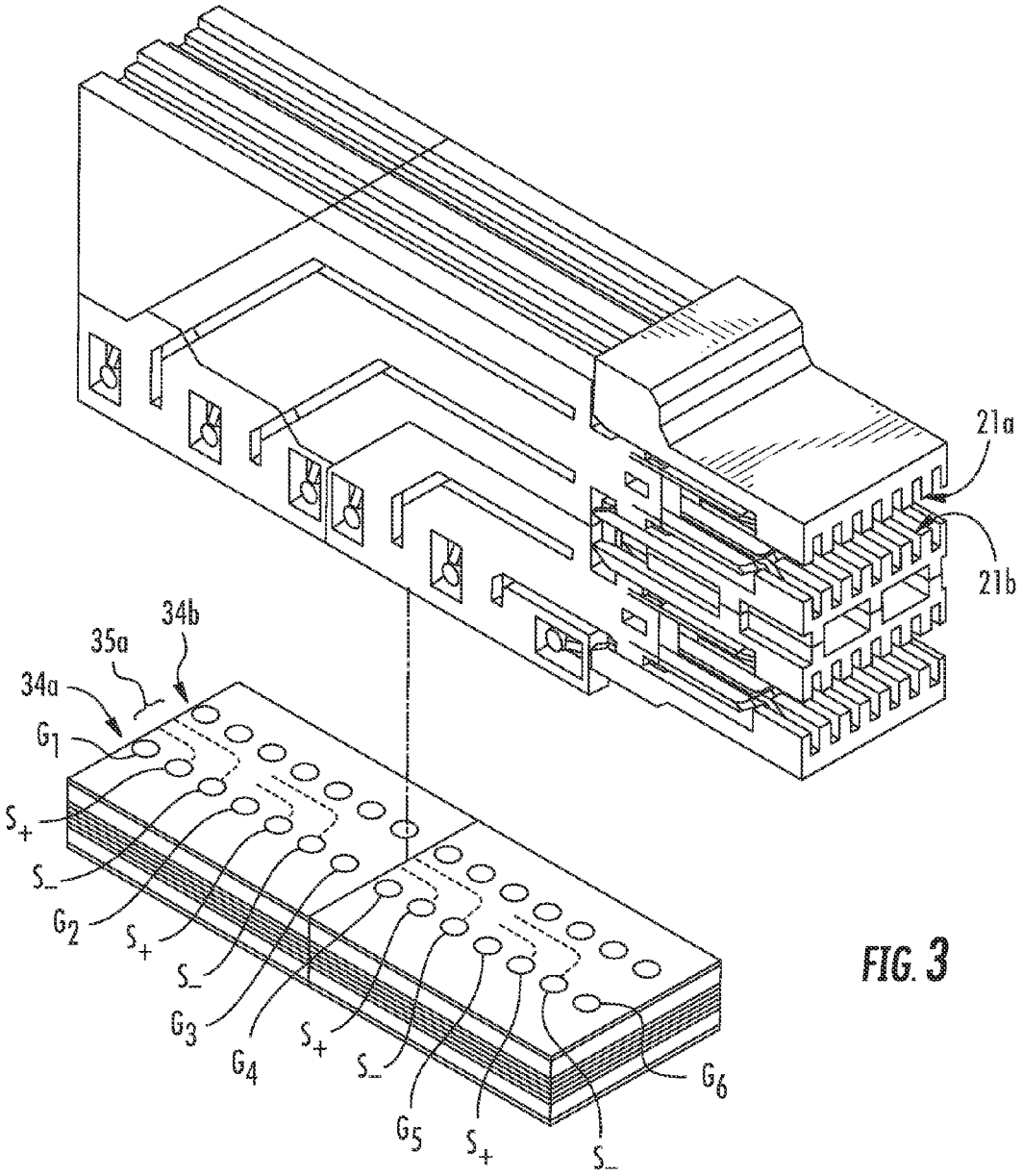
FIG. 3 illustrates a partially exploded perspective view of the connector depicted in FIG. 1.
Figure 4:
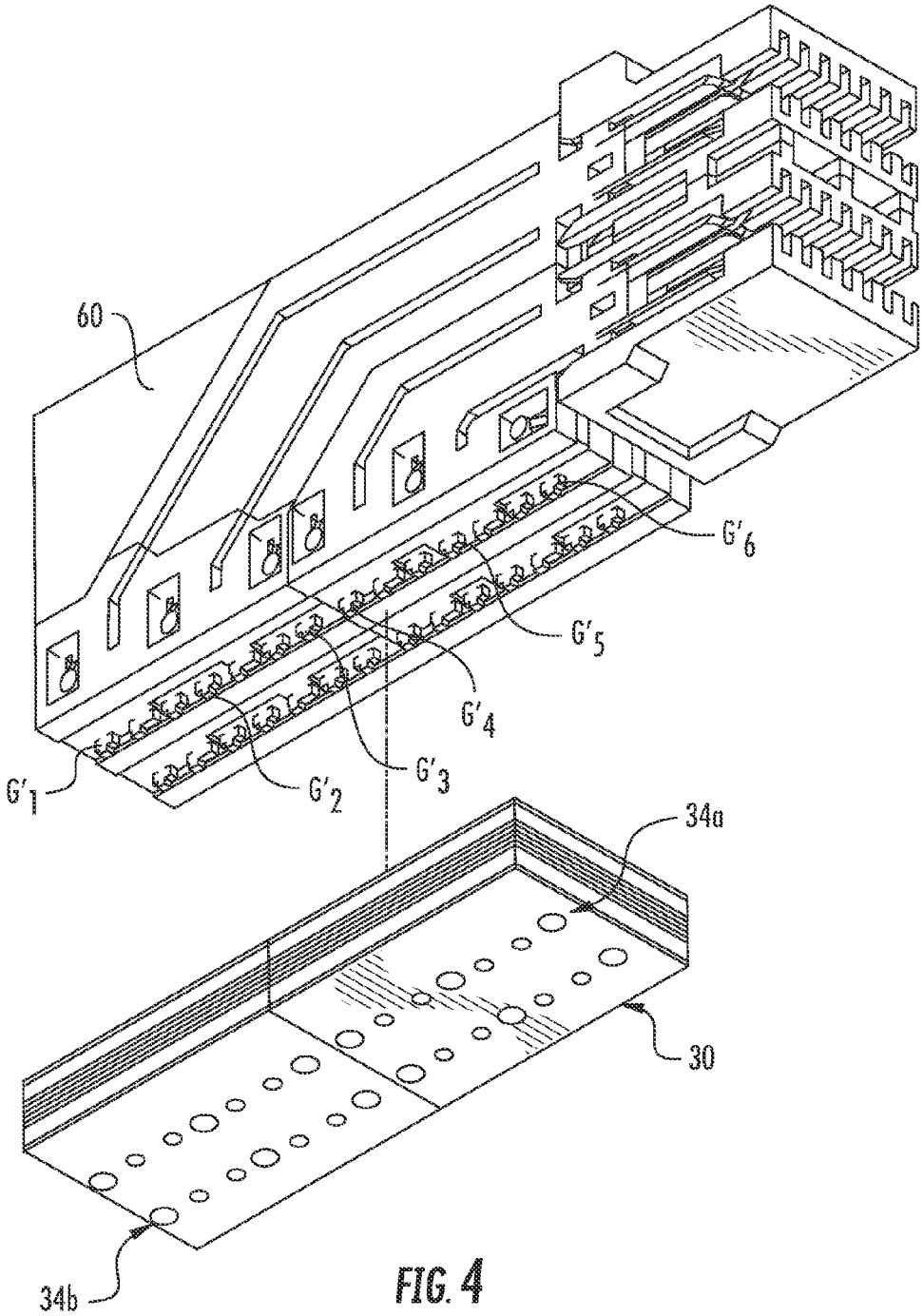
FIG. 4 illustrates another perspective view of the embodiment depicted in FIG. 3.
Figure 5:
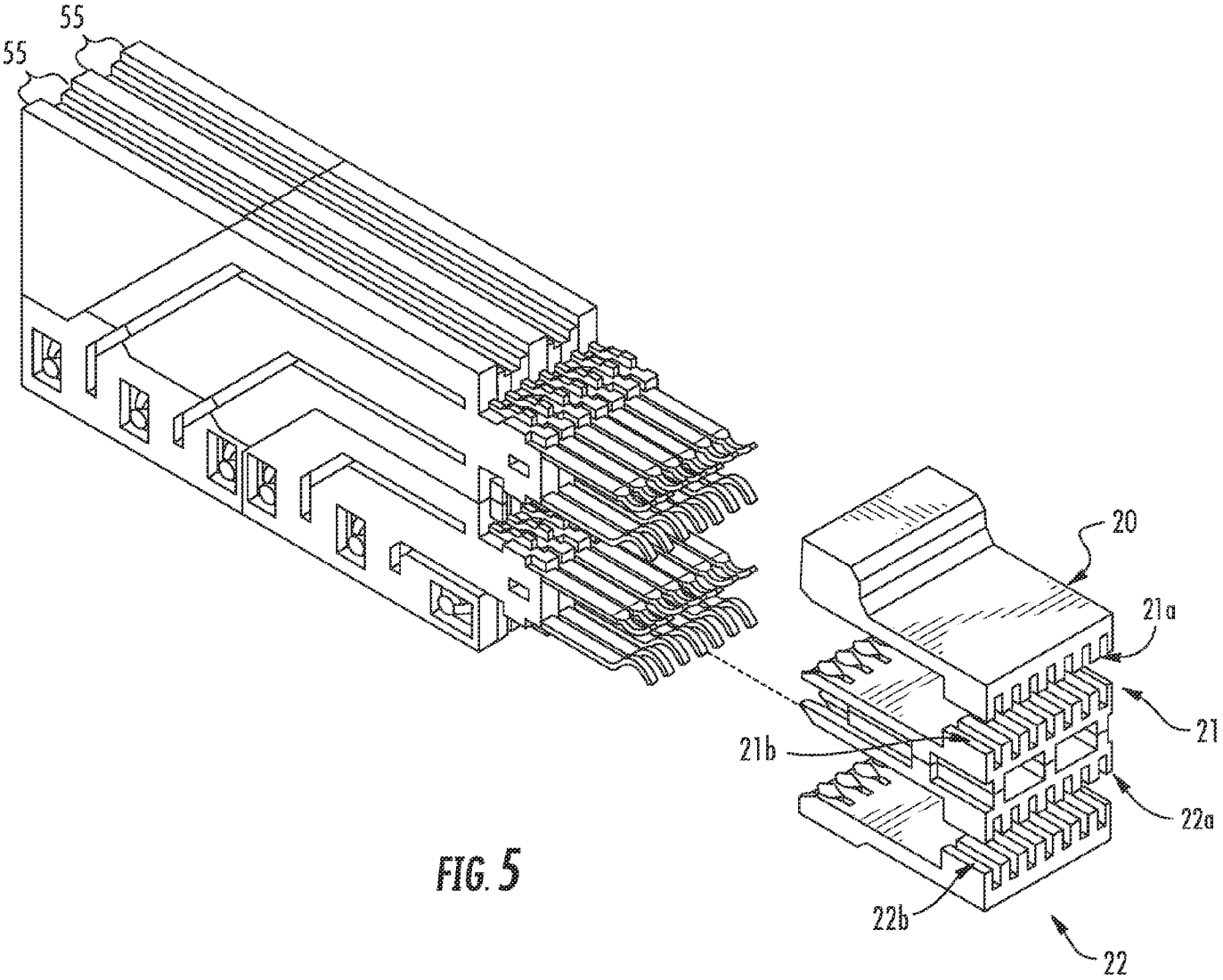
FIG. 5 illustrates a partially exploded perspective view of an embodiment of a connector.
Figure 6:
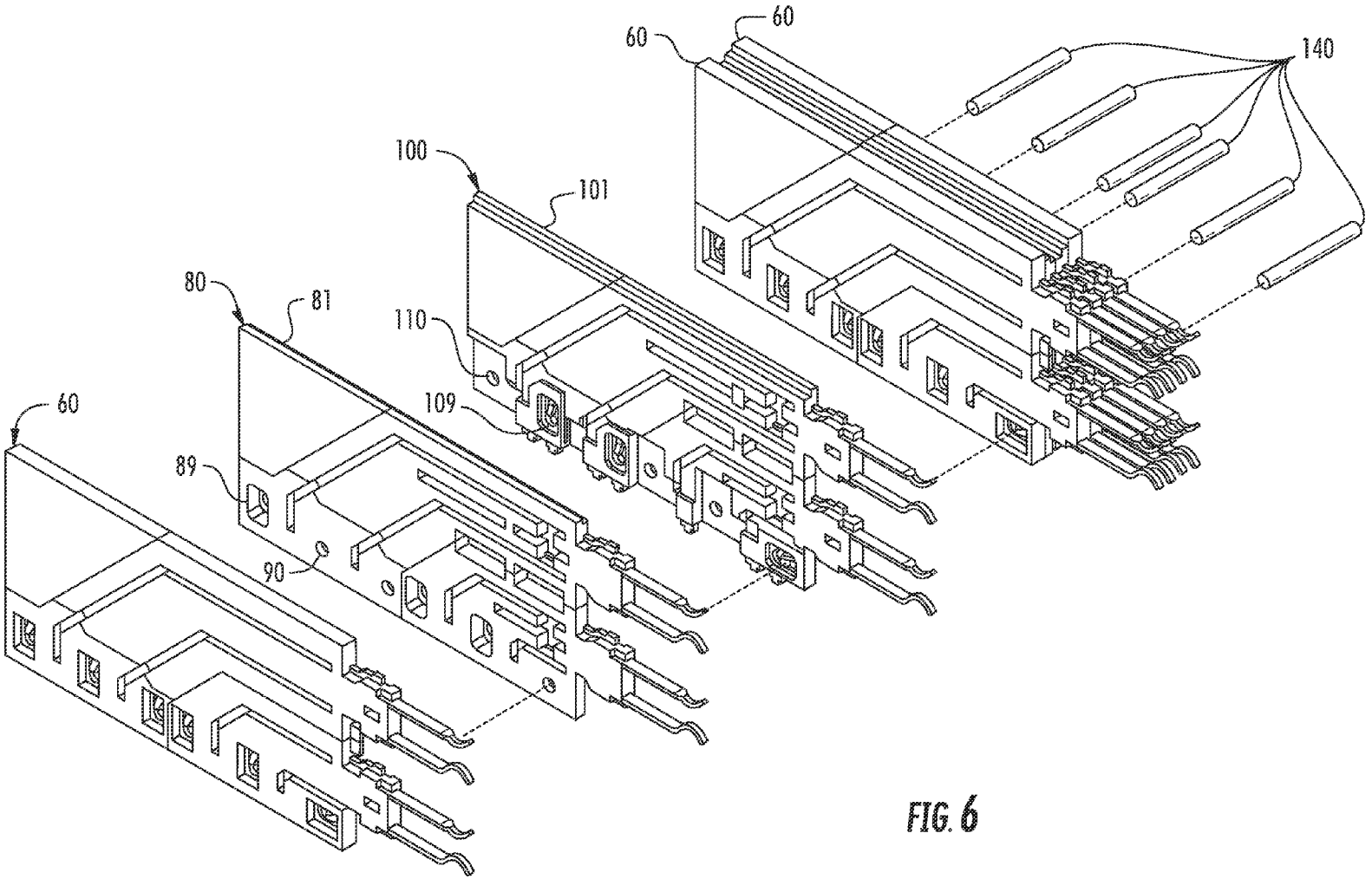
FIG. 6 illustrates a partially exploded perspective view of an embodiment of a wafer set.
Figure 7:
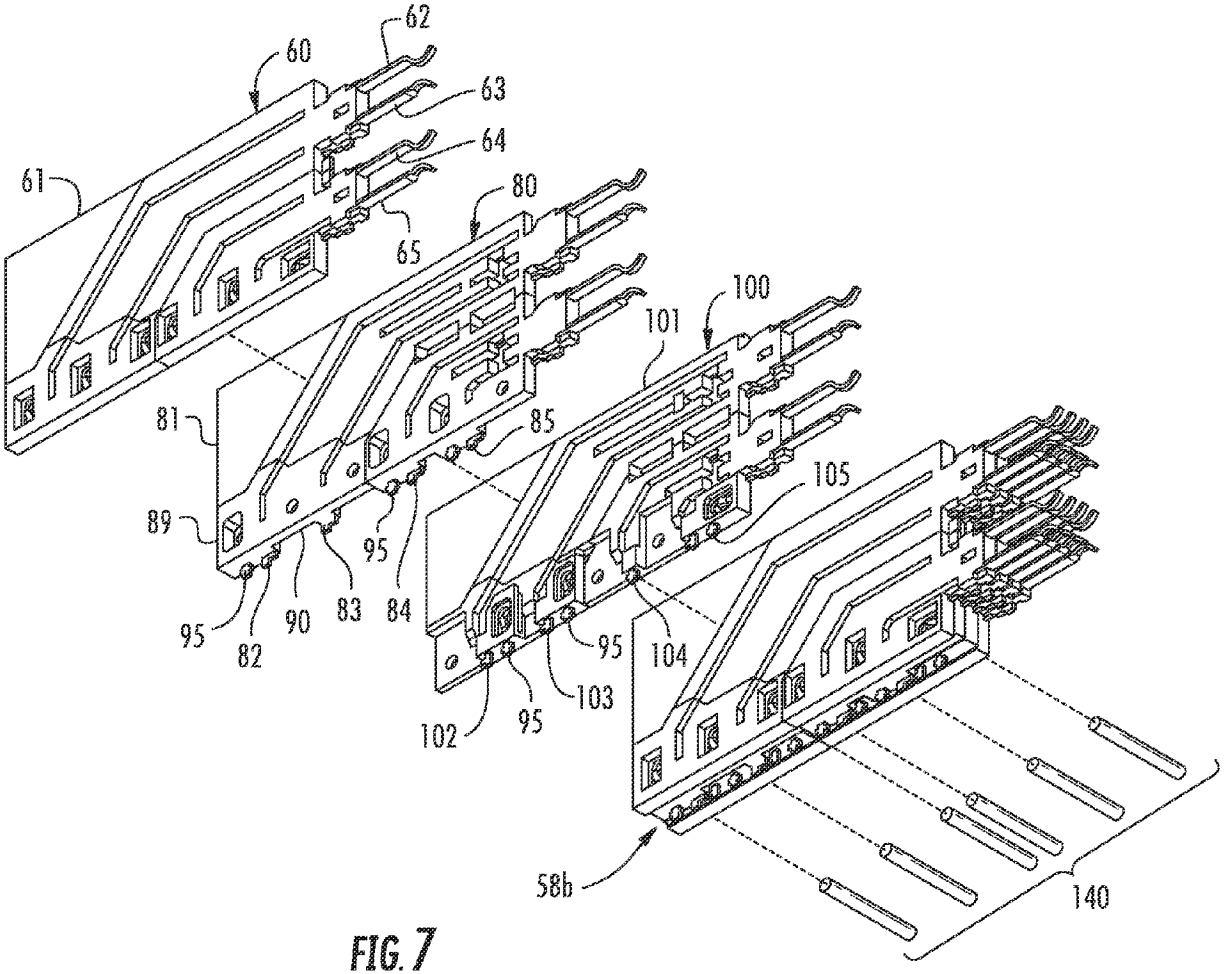
FIG. 7 illustrates another perspective view of the embodiment depicted in FIG. 6.
Figure 8A:
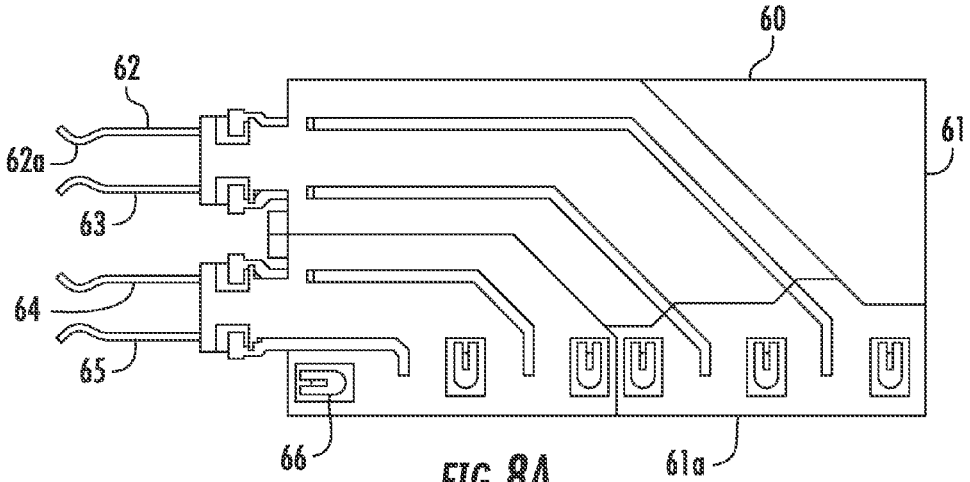
FIG. 8A illustrates an elevated side view of an embodiment of a ground wafer.
Figure 8B:
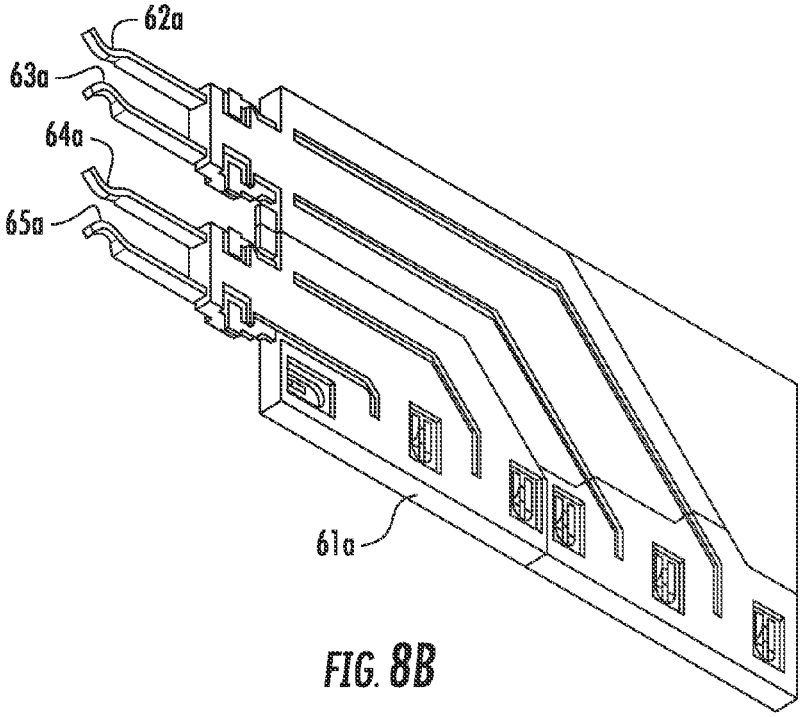
FIG. 8B illustrates a perspective view of the ground wafer depicted in FIG. 8A.
Figure 9A:
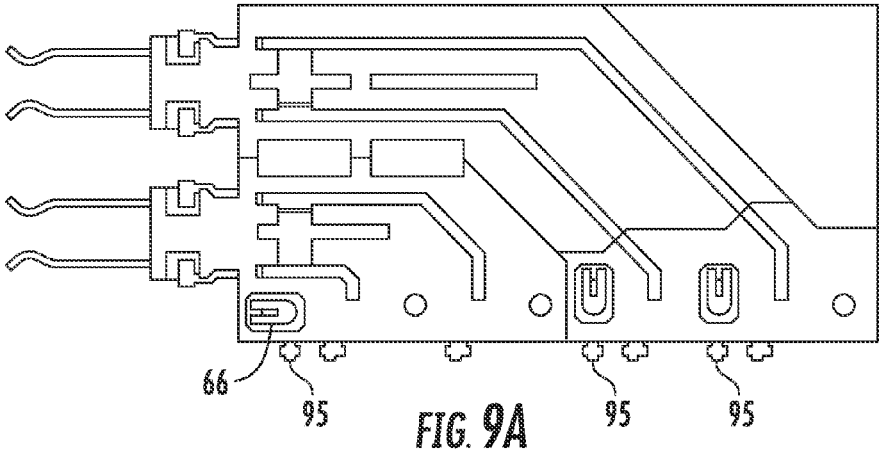
FIG. 9A illustrates an elevated side view of a signal wafer.
Figure 9B:
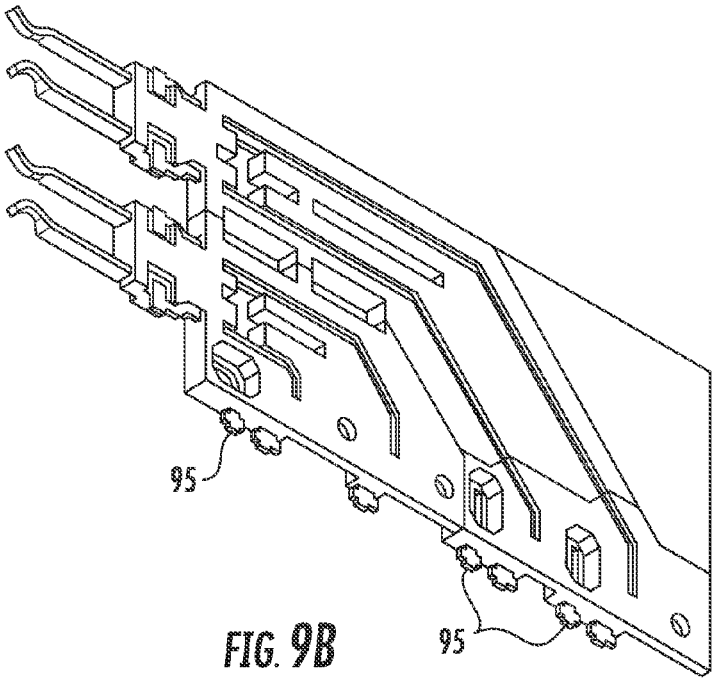
FIG. 9B illustrates a perspective view of the signal wafer depicted in FIG. 9A.
Figure 10A:
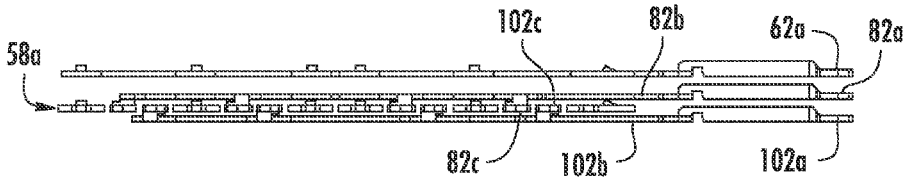
FIG. 10A illustrates a bottom view of a wafer triplet with the frames removed.
Figure 10B:
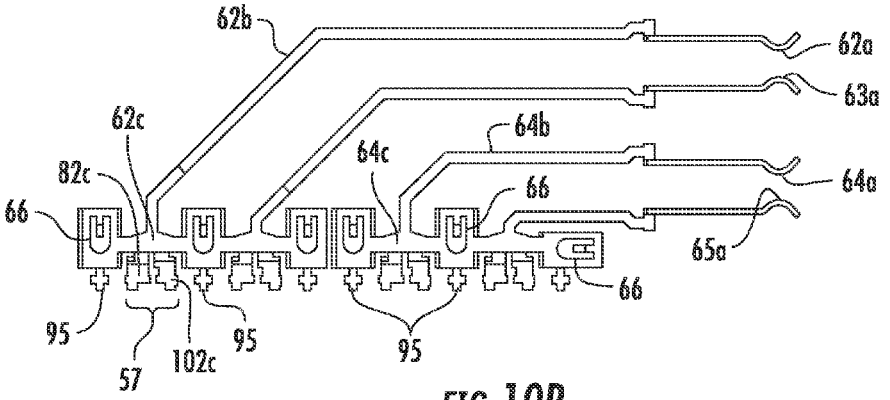
FIG. 10B illustrates an elevated side view of the embodiment depicted in FIG. 10A.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

FIGS. 1-10B illustrate features of a first embodiment. As can be appreciated, a connector system 10 includes a set of wafers 50 supported by a housing 20 that is positioned on a circuit board 30. While a partial housing 20 is disclosed, the housing can include sides, a top and rear wall in addition to front portion that supports card slots. Thus, any desirable housing may be provided. It should be further appreciated that while a stacked connector (e.g., two or more vertically arranged card slots) is depicted with a first card slot 21 and a second card slot 22, a single card slot could also be provided. The card slot 21 can have a first side 21*a* and a second side 21*b* and the second card slot can have a first side 22*a* and a second side 22*b*.

It should be noted that the depicted housing and wafers have lines indicating two or more piece construction. Such a construction was done for purposes of modeling and is not required in an actual part and it is expected that the various frames and housings can be formed in one piece using convention molding technology. Therefore, the depicted seam lines are not intended to be limiting.

As depicted, the set of wafers 50 includes a wafer triplet 55 that includes a ground wafer 60 with a frame 61, a first signal wafer 80 with a frame 81 and a second signal wafer 100 with a frame 101. The frame 61 of the ground wafer 60 supports a first ground terminal 62, a second ground terminal 63, a third ground contact 64 and a fourth ground terminal 65. Each of the ground terminals includes a contact 62*a*, 63*a*, 64*a*, 65*a* and a body 62*b*-65*b* and each ground terminal includes an end, such as end 62*c*. As depicted, the ground terminals do not have tails but do include junction 66.

The frame 81 of the first signal wafer 80 supports signal terminals 82-85 and each terminal includes a contact, a body and a tail. For example, terminal 82 includes a contact 82*a* and a body 82*b* and tails 82*c*. Similarly the frame 101 of the second signal wafer 100 supports terminals 102-105 and each terminal includes a contact, a body and a tail. For example, terminal 102 includes a contact 102*a*, a body 102*b* and a tail 102*c*. The terminals 62, 82, 102 are configured such that their respective contacts 62*a*, 82*a*, 102*a* are aligned side-by-side on the first side 21*a* of the first card slot 21 while the contacts 63*a*, 83*a*, 103*a* of terminals 63, 83, 103 are on the second side 21*b*. The same type of arrangement is also provided for the second card slot 22. Thus, the depicted embodiment also includes sufficient signal terminals such that wafers 80, 100 provide four signal pairs, each pair on an opposite side of one card slots 21, 22. Thus the depicted embodiment illustrates four terminals in each signal wafer so that the two signal wafers collectively provide four differential pairs.

As can be appreciated, the differential pairs are edge coupled in the contacts, broad-side coupled in the body and then edge coupled again at the tails. One benefit of the depicted design is that all the tails of the wafer triplet can be arranged in a single row 58*a*, 58*b*. This allows the circuit board to have its vias arranged in a corresponding single row 34*a*, 34*b*. In addition, the vias are configured so that a row has a $G_1$ via, a S+, S− pair, a $G_2$ via, a S+, S− pair, a $G_3$ via, a $G_4$ via, a S+, S− pair, a $G_5$ via, a S+, S− pair, and a $G_6$ via. In between the rows 34*a*, 34*b* are trace paths 35 that allows the signal traces in the board to be routed out in four layers while minimizing board space. In the depicted embodiment, for example, a first trace pair 33*a* can be routed out on a first layer, a second trace pair 33*b* can be routed out on a second layer, a third trace pair 33*c* can be routed out on a third layer and a fourth trace pair 33*d* can be routed out on a fourth layer, all while staying between a first via row 34*a* and a second via row 34*b*. Such a design is particularly helpful when the number of layers available is sufficient to support the multiple rows of traces and the horizontal board space needs to be conserved. Furthermore, such a design is well suited to ganged applications because connectors can be placed beside each other without the need to worry about traces needing to fan out in order to route out the connector on the circuit board, even if the connector is a stacked configuration. Thus the depicted connector allows for simple routing of the traces. In addition the simple routing configuration that is possible tends to improve the performance on the circuit board as there are reduced losses in the circuit board compared to existing designs that route around different ground vias (typically providing more of a fan-out routing in the circuit board).

As can be appreciated, the ground terminals include junctions that intended to be electrically connected to tail stubs 95. Thus, the ends of the ground terminals are electrically connected to the tail stubs 95 via conductive members 140 that connect to junctions 66 in the tail stubs 95 and the ground terminals. As depicted, there are three junctions 66, one on each side of the ends of ground terminals 62*a* and 62*b*, and the ends of the ground terminals are connected together with a bar 68*a*, 68*b* that includes the three junctions 66. Tail stubs 95 are supported by the signal wafers 80, 100 so as to provide grounds $G'_1$, $G'_2$, $G'_3$, $G'_4$, $G'_5$, $G'_6$ and the conductive member 140 ensures that there is a return to ground path for each ground terminal so that the ground terminals can be electrically connected to a ground via (such as ground vias $G_1$, $G_2$, $G_3$, $G_4$, $G_5$, $G_6$) with the grounds. As depicted, the majority of the tails stubs 95 can be configured to be the same design, which can help to keep the overall costs lower and may also provide more consistent performance.

It should be noted that while ground terminals are depicted as being substantially the same size as the signal terminals, in alternative embodiments the ground terminals could be provided as shields that are at least twice as wide as the signal terminals and in certain embodiments the ground terminal should be replaced with a shield that would extend between and overlap the ground terminals 62*a*, 62*b*. In addition, a wide shield that extends across substantially the entire ground wafer could also be provided. In each embodiment, the junctions 66 and conductive members 140 would allow the ground terminals/ground shield to electrically couple to tails stubs that are electrically coupled to ground (e.g., provide a return path for energy carried on the ground terminals).

As depicted, the signal wafers are configured so that signal wafer 80 includes three ground stubs 70 and signal wafer 100 includes three ground stubs 70. This allows, when looking at a row, a ground, signal, signal, ground, signal, signal, ground pattern that is repeated. Thus, signal pairs 57 are positioned between ground vias and two ground vias are positioned between the signals pairs in the first and second card slot. The additional ground via helps provide further electrical isolation between the top and bottom card slot and can help reduce cross-talk in a connector that is configured to be compactly designed such that there is limited space between vertical card slots.

Figure 11:
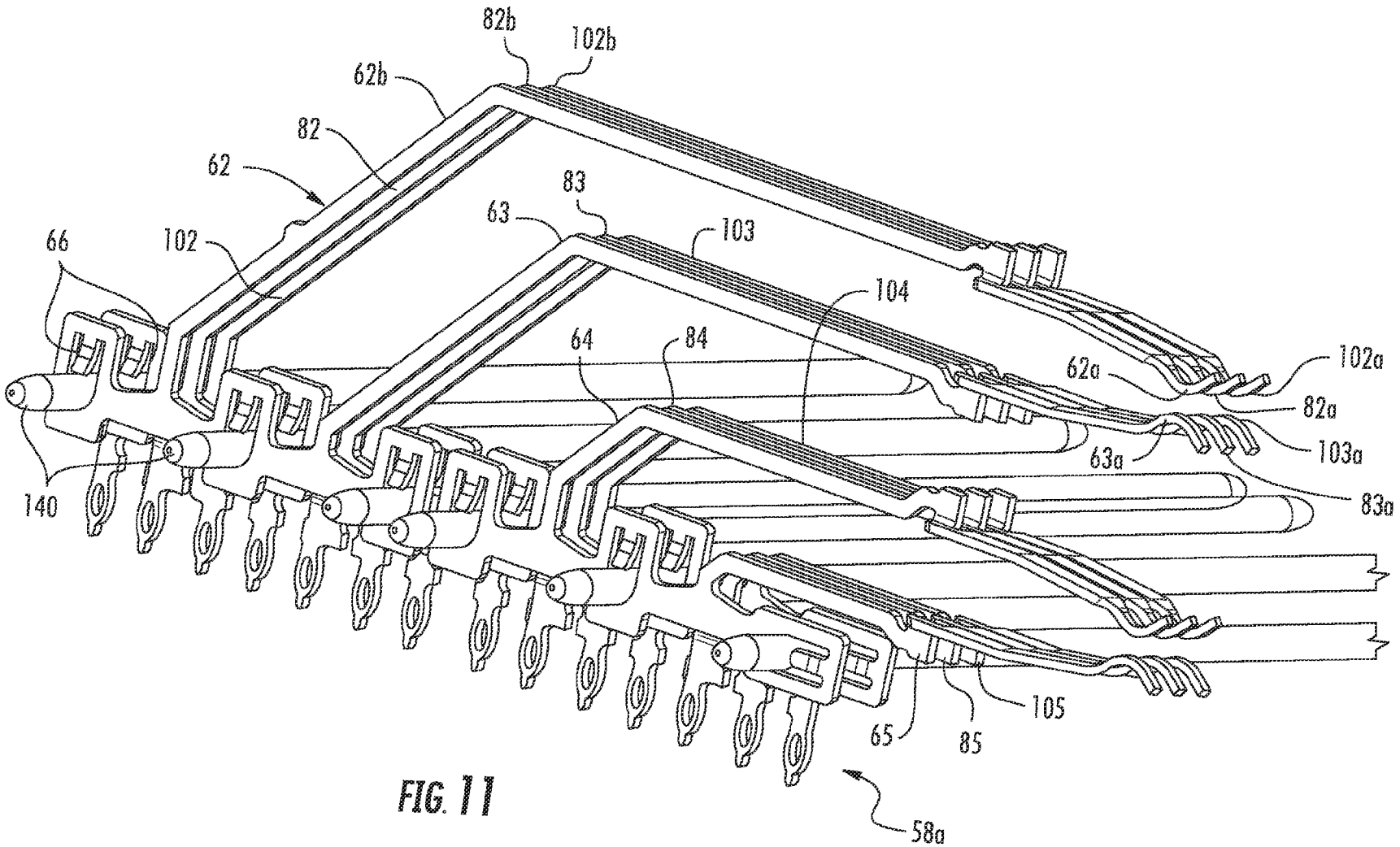
FIG. 11 illustrates a simplified perspective view of an embodiment of a connector.
Figure 12:
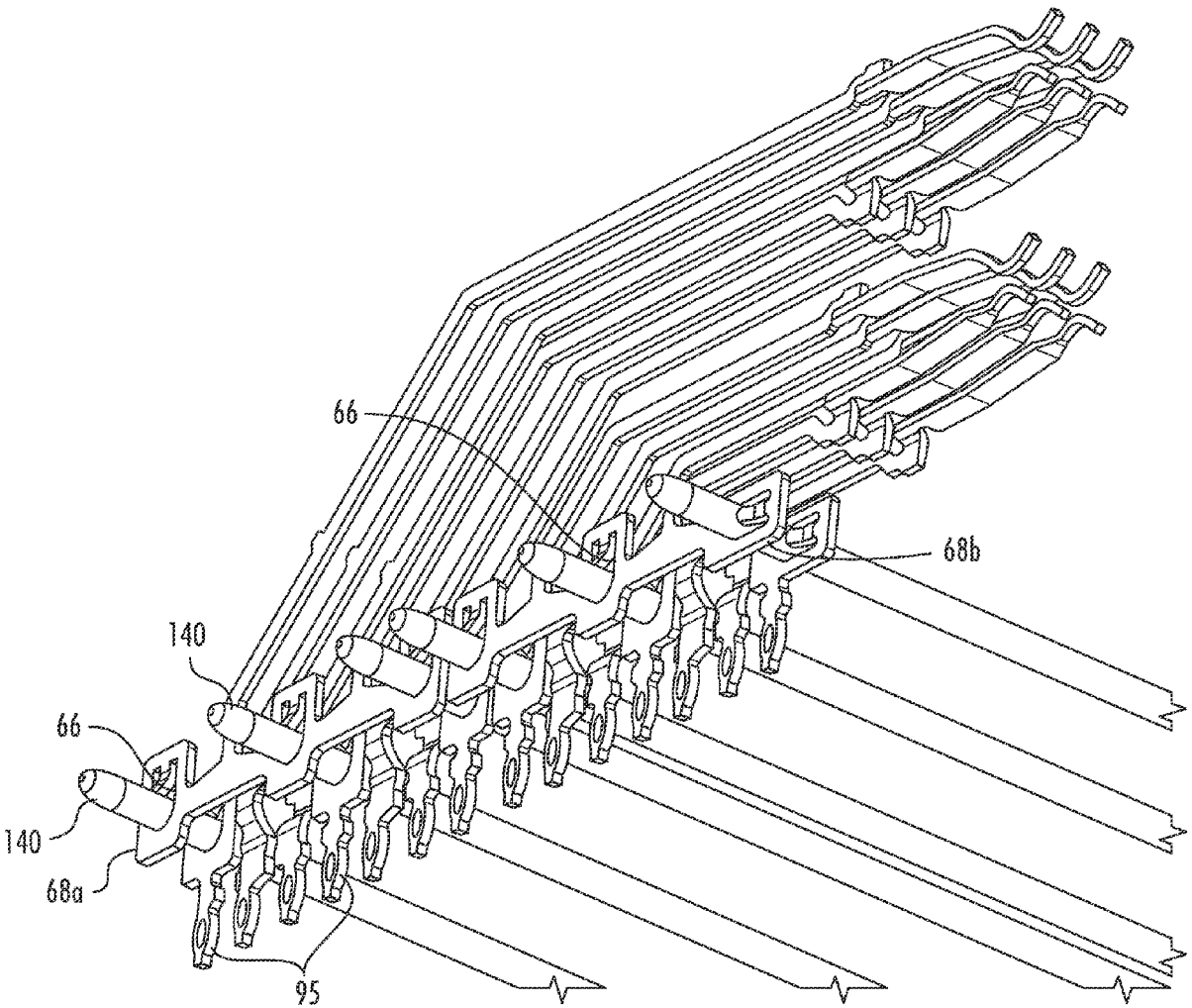
FIG. 12 illustrates another perspective view of the embodiment depicted in FIG. 11.
Figure 13:
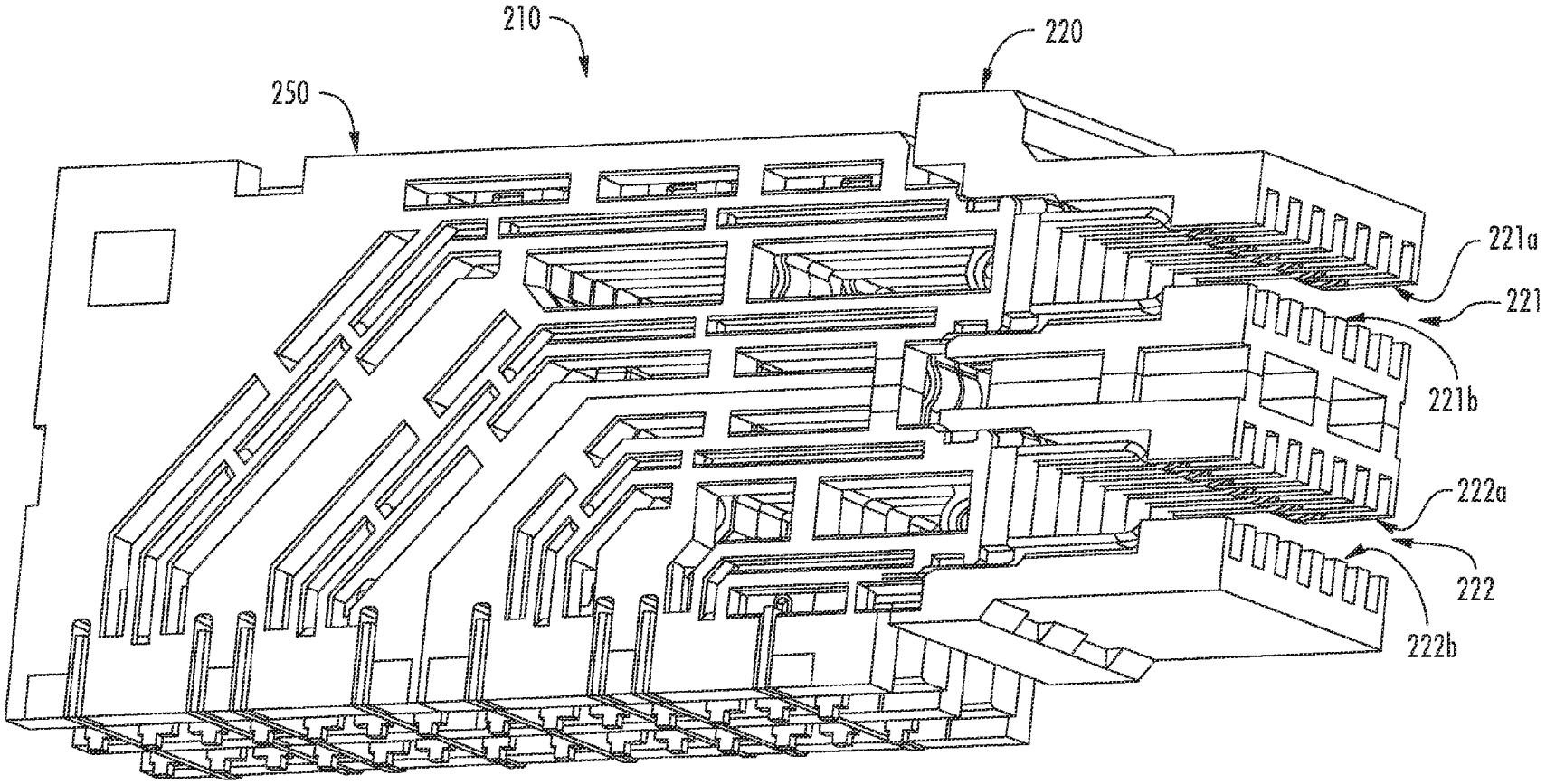
FIG. 13 illustrates a perspective view of another embodiment of a connector.
Figure 14:
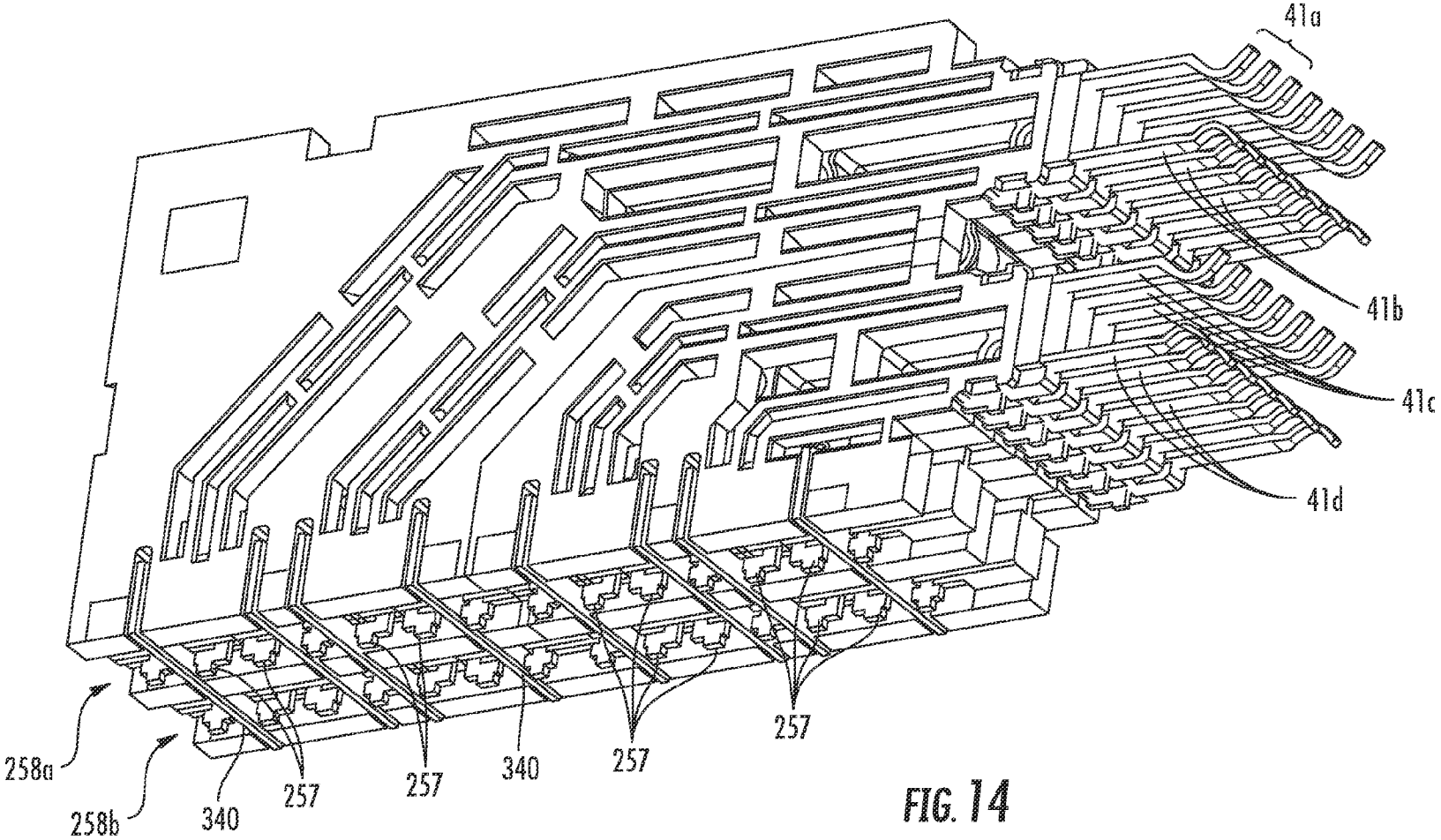
FIG. 14 illustrates a simplified perspective view of the embodiment in FIG. 13.
Figure 15:
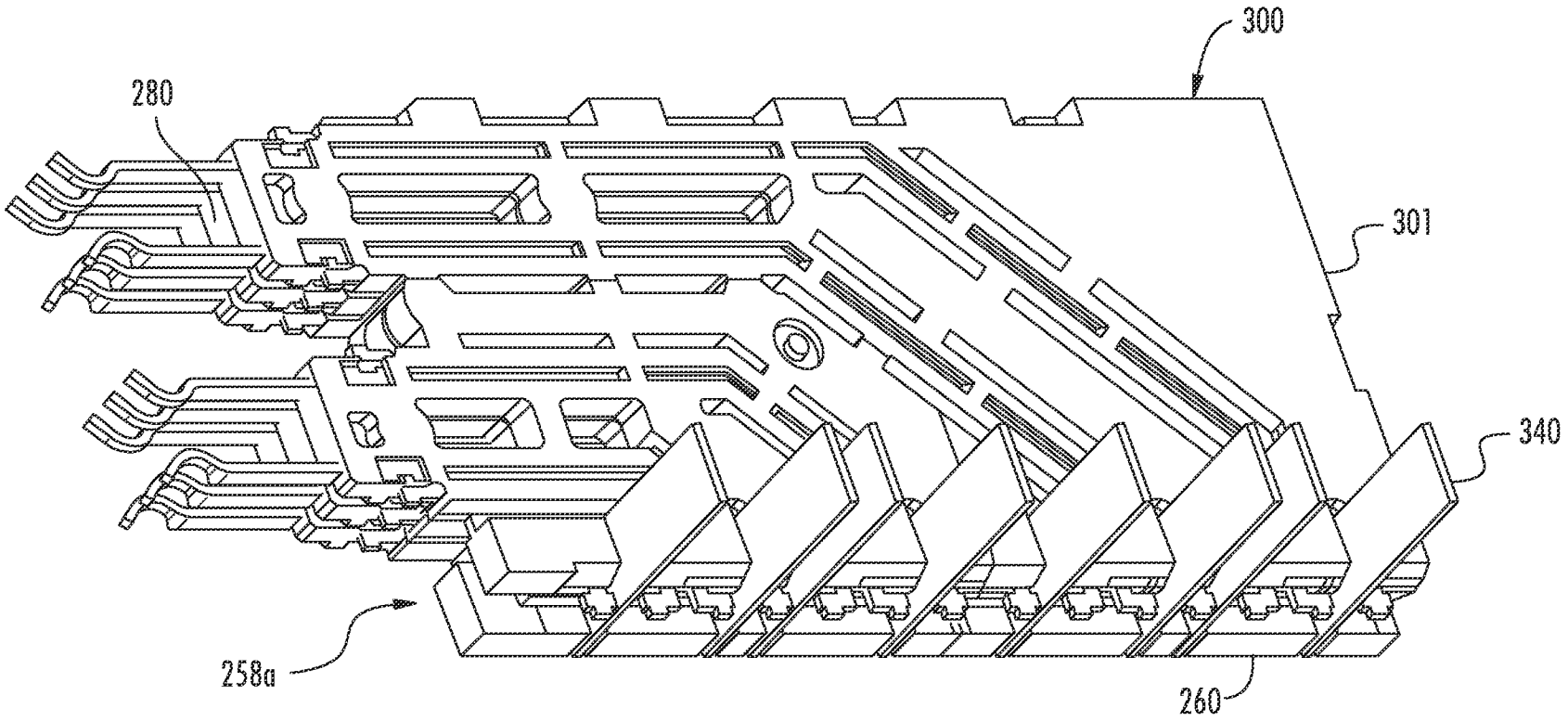
FIG. 15 illustrates a simplified perspective view of the embodiment depicted in FIG. 13.
Figure 16:
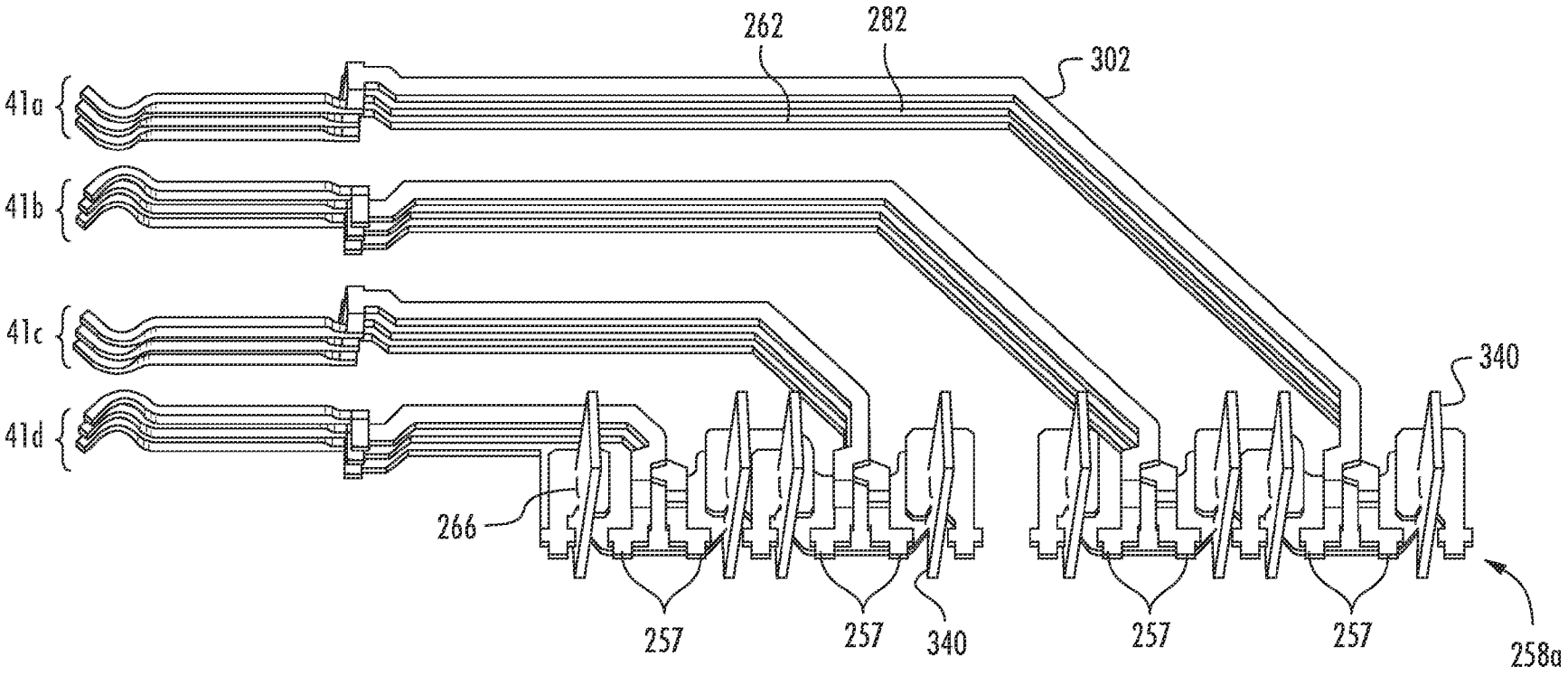
FIG. 16 illustrates a perspective view of the embodiment depicted in FIG. 15 with the frames omitted for purposes of illustration.
Figure 17:
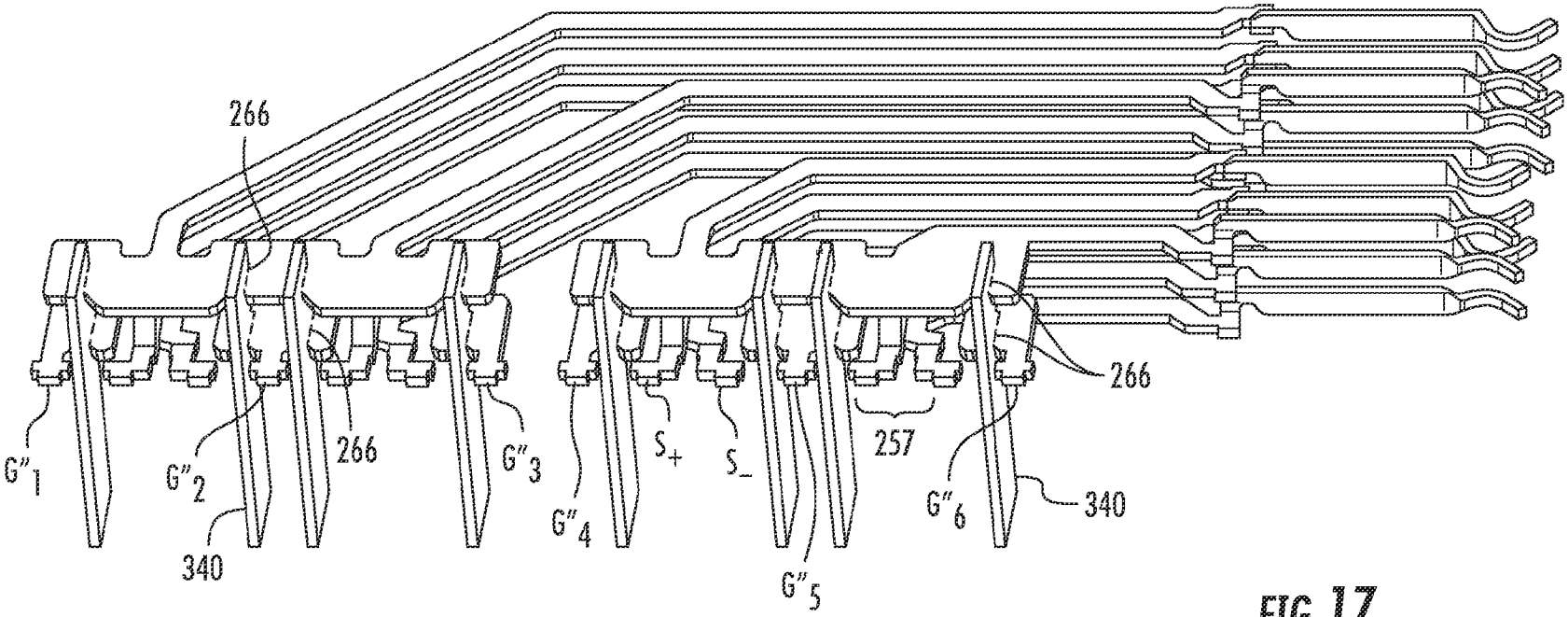
FIG. 17 illustrates another perspective view of embodiment depicted in FIG. 16.
Figure 18:
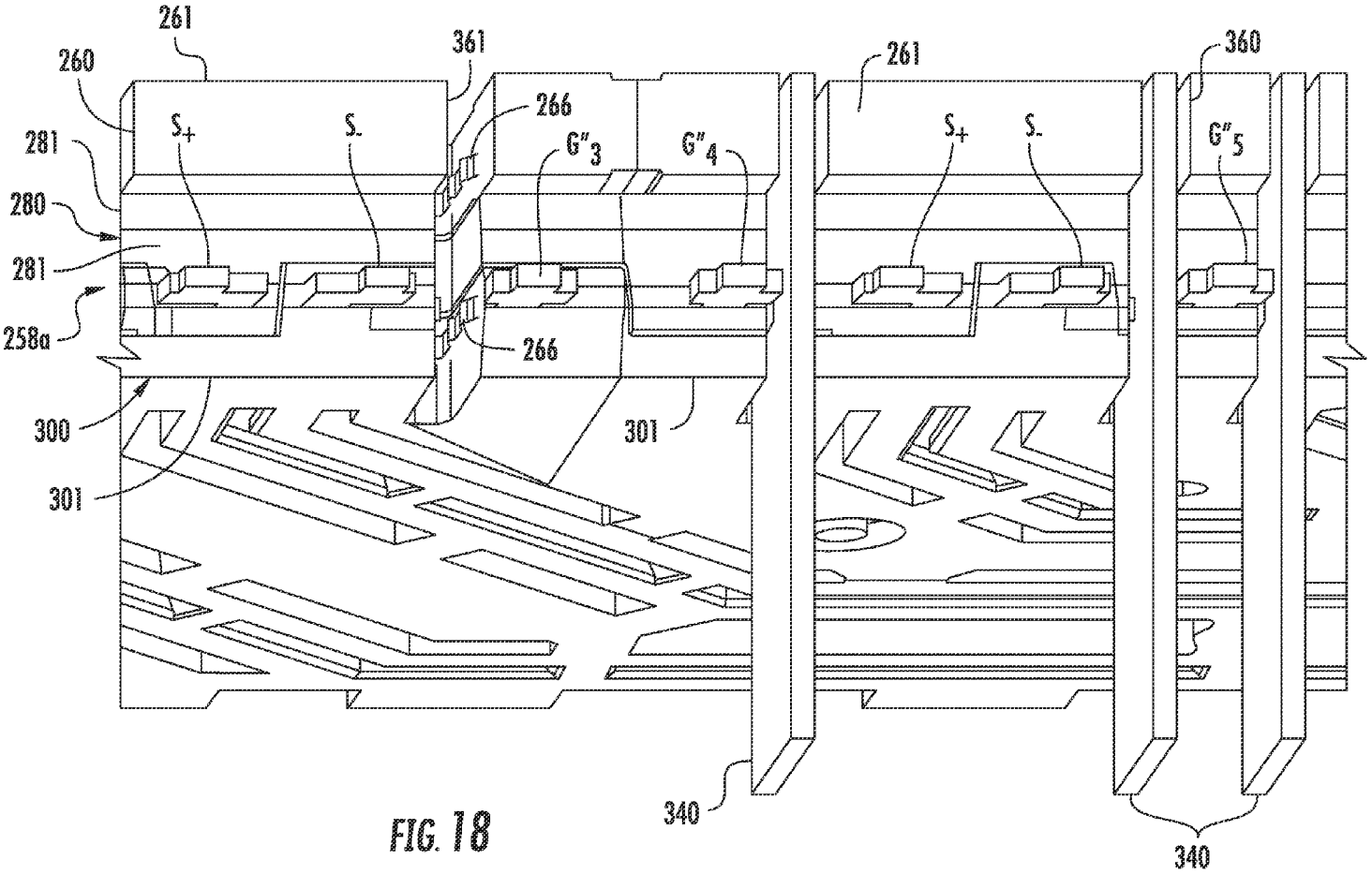
FIG. 18 illustrates a perspective view of the bottom of a plurality of wafers.

As can be appreciated from FIGS. 11 and 12, which illustrate features that can be included in design illustrated in FIGS. 1-10B, the tails can be configured to be a press-fit style. Alternatively, the tails can be a simple through-hole style or any other desired tail configuration.

FIGS. 13-19 illustrate another embodiment of a connector that can be used to provide straight-back routing. It should be noted that the use of straight back routing is not required but it is expected to provide space saving benefits on the circuit board. Thus, unless otherwise noted, the style of routing on the circuit board is not intended to be limiting.

A connector 210 includes a housing 220 with a wafer set 250. The housing can include two card slots 221, 222 and each card slot can include a first side 221*a*, 222*a* and a second side 221*b*, 222*b*. As can be appreciated, the card slots 221, 222 are on a mating face of the connector 210 and the tails are on a mounting face of the connector 210. As in the above embodiment, triplets 41*a*, 41*b*, 41*c*, 41*d* are positioned on opposite sides of their respective card slots but are all configured to be connected to a supporting circuit board in the row 258*a*, thus row 258*a* includes four terminal pairs 257 and each terminal pair 257 is separated from another terminal pair in the row 258*a* by at least tail that is connected to a ground terminal by a conductive member 340. As in the above embodiments, the ground tails are formed by tail stubs that are also in the row 258*a* and the tail stubs are electrically isolated from the signal terminals.

Similar to the above embodiment, the connector includes rows 258*a*, 258*b* of tails and conductive members 340 are used to connect junctions 266 in the bars of the ground terminals to junctions 266 in tail stubs. The tail stubs provide grounds $G''_1$, $G''_2$, $G''_3$, $G''_4$, $G''_5$, $G''_6$. As in the above embodiment, signal pairs S+, S− are positioned so that a ground is on each side of the signal pair.

The conductive members 340 can be shaped like flat plates and the additional surface area can provide additional shielding between signal pairs within a row. The conductive members 340 can be pressed into channels 361 in the bottom of the wafers (e.g., inserted into the wafers on the mounting side) so that the conductive members 340 can engage the junctions 266 supported by the frames 261, 281, 301. As can be appreciated, the conductive member extends past the frames 281, 301 in the case of a channel 360. In an embodiment, each signal pair will have a conductive member 340 positioned on opposing sides.

Figure 19:
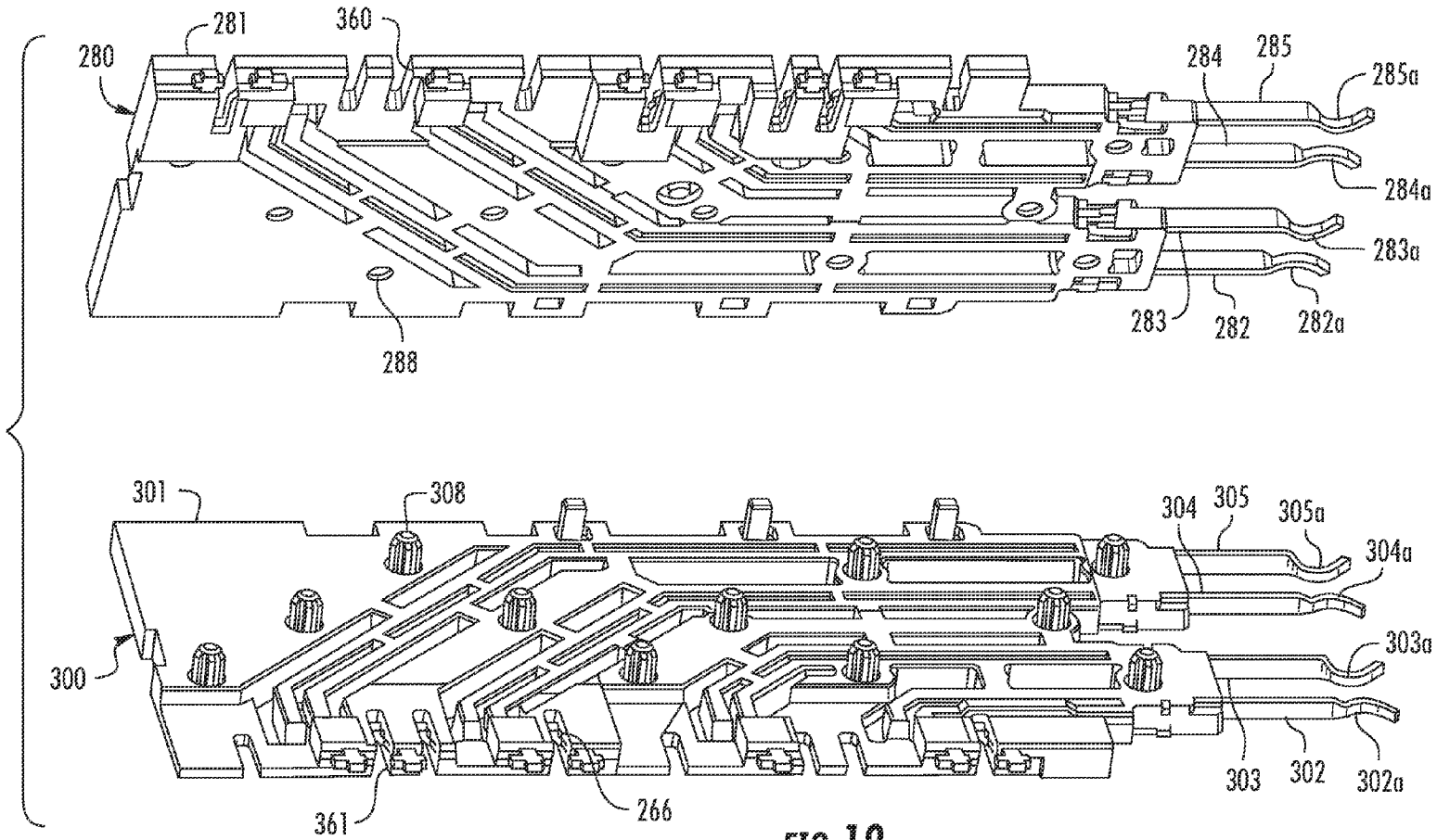
FIG. 19 illustrates a perspective view of two adjacent signal wafers, illustrating features that can coupled the signal wafers together.

As can be appreciated from FIG. 19, the signal wafers 280, 300 are configured so that their various features interweave with corresponding features in the other wafer. This allows the tails of the signal terminals to be offset toward the row center line. In addition, other features can help hold the wafers together. For example, projections 308 can be configured to engage notches 288. Such construction is not required but helps provide additional spacing control between the two signal wafers and is expected to help improve performance at higher signaling frequencies and associated data rates.

Figure 20:
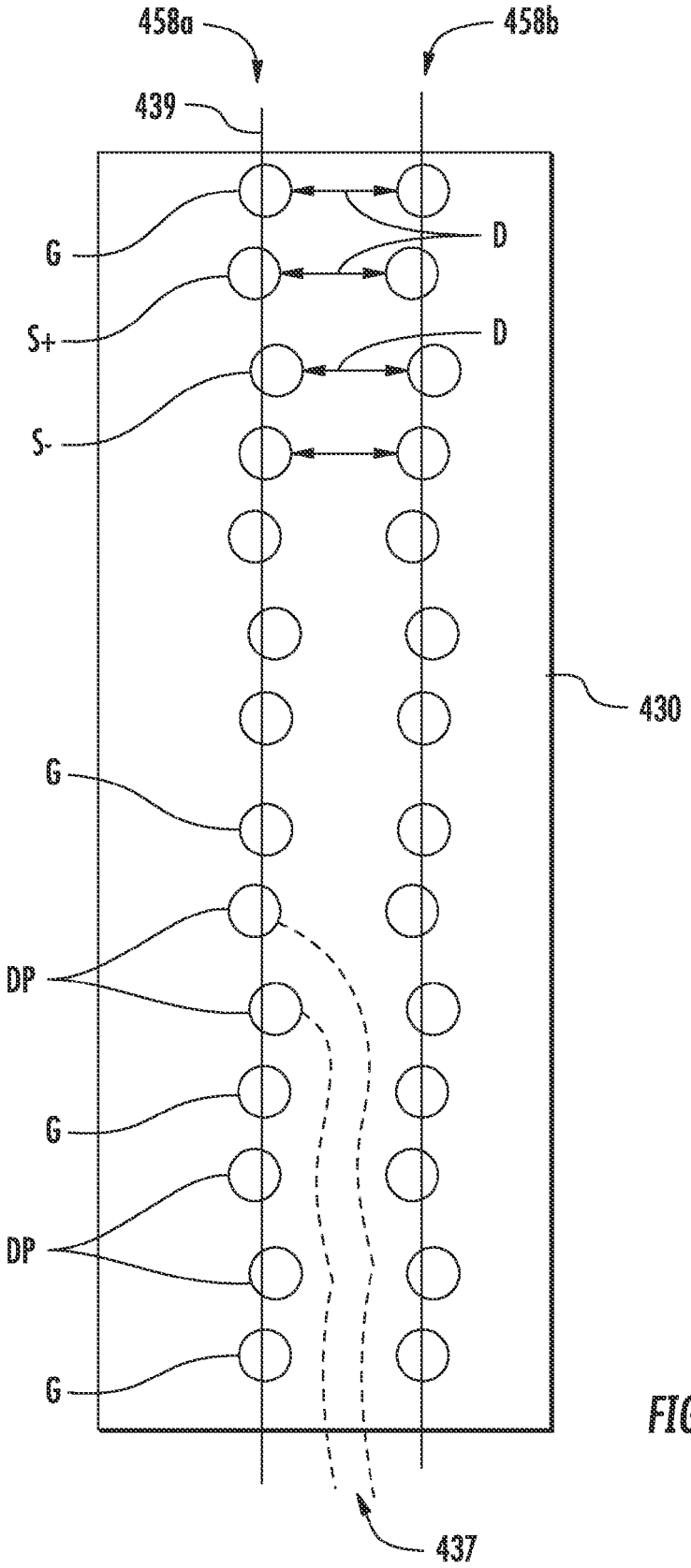
FIG. 20 illustrates an embodiment of a pair of traces extending between two rows of vias.

FIG. 20 illustrates an embodiment of a circuit board 430 in which the rows 458*a*, 458B have a slight meander in them rather than being a straight line. As can be appreciated, in the depicted embodiment an average center 439 of each row intersects each of the ground vias G and signal vias S+, S−. It should be noted that the average center 439 of FIG. 20 extends through the center of each ground via G but such an alignment, while beneficial to ensure good electrical performance, is not required. It is helpful to ensure that the spacing between like vias in adjacent rows can be kept at a constant distance D, or at least substantially similar distance. As can be appreciated, the meandering of the row causes the trace path 437 to meander. Traces extending along the trace path can meander to match the meander of the trace path 435 (such a configuration is expected to provide superior electrical performance) or can run straight and alternatively get closer to one row or the other (such a configuration is expected to be simpler to route). As in the above embodiment, two ground vias G are positioned between the top and bottom port. If further electrical enhancement is desired, the connector mating interface can be lengthened so that two ground vias are positioned between each differential pair DP. Thus, the depicted connector can readily be modified to provide additional performance enhancements. Naturally, an embodiment with a circuit board as depicted in FIG. 20 will have a connector where the signal terminals tails are offset a different amount than half a wafer thickness (typically less than half a wafer thickness), thus a connector is not limited to depicted embodiments that show the terminals offset by half a wafer thickness).

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector, comprising:

a housing have a card slot;

a first wafer having a first and second ground terminal, the first and second ground terminals having, respectively, a first and second contact positioned on opposite sides of the card slot, the first wafer having a bar electrically connecting the first and second ground terminal, the bar including a plurality of first junctions;

a second wafer having a first signal terminal and a second signal terminal, the second wafer supporting a plurality of tail stubs, the signal terminals each having a contact, a signal tail and a body extending therebetween, the contacts of the first and second signal terminals positioned on opposite sides of the card slot and the plurality of tail stubs each having a second junction and a ground tail;

a third wafer having a third signal terminal and a fourth signal terminal, the third and fourth signal terminals each having a contact, a signal tail and a body extending therebetween, the contacts of the third and fourth signal terminals positioned on opposite sides of the card slot, the first terminal of the second wafer and the third terminal of the third wafer forming a first broad-side coupled differential pair and the second terminal of the second wafer and the fourth terminal of the third wafer forming a second broad-side coupled differential pair; and a plurality of conductive members electrically connecting the first junctions with the second junctions.

2. The connector of claim 1, wherein the tails in the second and third wafer are in a single row.

3. The connector of claim 2, wherein the contacts are in a horizontal orientation and the row of tails extends in a direction transverse to the horizontal direction, the row include the ground tails.

4. The connector of claim 3, wherein the row is a straight line.

5. A connector, comprising:

a housing having a first side and a mounting side, the first side including a card slot and the mounting side configured to be mounted on a circuit board;

a first wafer that supports a plurality of first signal terminals, each first signal terminal including a contact, a tail and a body extending therebetween;

a second wafer that supports a plurality of second signal terminals, each second signal terminal including a contact, a tail and a body extending therebetween, the bodies of the first and second signal terminals being in a broad-side coupled relationship, wherein at least one of the first and second wafers supports a plurality of tail stubs;

a third wafer that supports a plurality of ground terminals, each ground terminal including a contact and a body and an end, the ground terminals not including a tail; and at least one commoning member electrically connecting the ends to the tail stubs.

6. The connector of claim 5, wherein the tails of the signal terminals and the tail stubs are in a single row.

7. The connector of claim 6, wherein the row is a straight line.

8. The connector of claim 5, wherein the ends of the ground terminals are commoned within the third terminal.

9. The connector of claim 5, wherein the wafers have a mounting face and the commoning member is inserted into the wafers from the mounting face.

10. A connector, comprising:

a housing with a card slot on a first face, the card slot having a first side and a second side; and a plurality of wafers arranged in pattern that includes a ground wafer, a signal wafer and a signal wafer, each of the plurality of wafers supporting a first signal terminal and a second signal terminal, the first signal terminal having a contact on the first side and the second signal terminal having a contact on the second side, ground terminals each having an end, the ends being electrically connected to tail stubs supported by the signal wafers.

11. The connector of claim 10, wherein tail stubs and the tails of the signal terminals are in a single row.

12. The connector of claim 10, wherein the row is a straight line.

* * * * *